US007462071B1

(12) United States Patent
Wu

(10) Patent No.: US 7,462,071 B1
(45) Date of Patent: Dec. 9, 2008

(54) CABLE CONNECTOR WITH ANTI CROSS TALK DEVICE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/897,819

(22) Filed: Aug. 31, 2007

(51) Int. Cl.
*H01R 13/648* (2006.01)

(52) U.S. Cl. ..... 439/608; 439/497

(58) Field of Classification Search ..... 439/497, 439/493, 607, 608

See application file for complete search history.

(56) References Cited

U.S. PATENT DOCUMENTS 6,077,115 A * 6/2000 Yang et al. ..... 439/567
6,454,605 B1 9/2002 Bassler et al.
7,267,579 B1 * 9/2007 Wu ..... 439/610
7,311,552 B1 * 12/2007 Ko ..... 439/579
7,390,220 B1 * 6/2008 Wu ..... 439/608

* cited by examiner

*Primary Examiner*—Phuong K Dinh
(74) *Attorney, Agent, or Firm*—Wei Te Chung

(57) ABSTRACT

A cable connector (100) includes an insulated housing (2) defining a receiving space (20), a plurality of terminals (3) being arranged into an upper and a lower terminal rows and received in the receiving space (20) of the insulated housing (2), a metal plate (5) disposed between the upper terminal row and the lower terminal row, a printed circuit board (6) electrically connecting with the terminals (3) and the metal plate (5), and a cable (8) including a number of wires (81) electrically coupled to the printed circuit board (6).

18 Claims, 8 Drawing Sheets

CABLE CONNECTOR WITH ANTI CROSS TALK DEVICE

BACKGROUND OF THE INVENTION

1. Field of the Invention

The present invention generally relates to a cable connector, and more particularly to a cable connector used in high-speed signal transmission.

2. Description of Related Art

In recent years, human has benefited much from the fast developing digital industry. The digital industry brings us a multiple of products, such as personal computer (PC) and consumer electronic (CE) products including TV, DVD player, game console, etc. Usually, either PC or CE product has a display for showing video, and a cable connector is needed to connect an interface of the display and a control device. A display port connector may be an ideal I/O port adapted for both PC and CE product. However, cross talk problem often occurs at interface section of the display port connector, which may influence the quality of signals.

Hence, an improved cable connector is highly desired to overcome the aforementioned problems.

SUMMARY OF THE INVENTION

Accordingly, an object of the present invention is to provide an anti cross talk cable connector to improve signal transmitting quality.

In order to achieve the object set forth, a cable connector in accordance with the present invention comprises an insulated housing defining a receiving space, a plurality of terminals being arranged into an upper and a lower terminal rows and received in the receiving space of the insulated housing, a metal plate disposed between the upper terminal row and the lower terminal row, a cable including a number of wires electrically connecting with the terminals and a printed circuit board having a plurality of conductive traces and a grounding pad arranged thereon. The grounding terminals couple to a pre-selected conductive traces of the printed circuit board. The tail portion of the metal plate electrically connects to the grounding pad. The grounding pad further electrically connects with the pre-selected conductive traces of the printed circuit board.

Other objects, advantages and novel features of the invention will become more apparent from the following detailed description when taken in conjunction with the accompanying drawings.

DETAILED DESCRIPTION OF THE INVENTION

Figure 1:
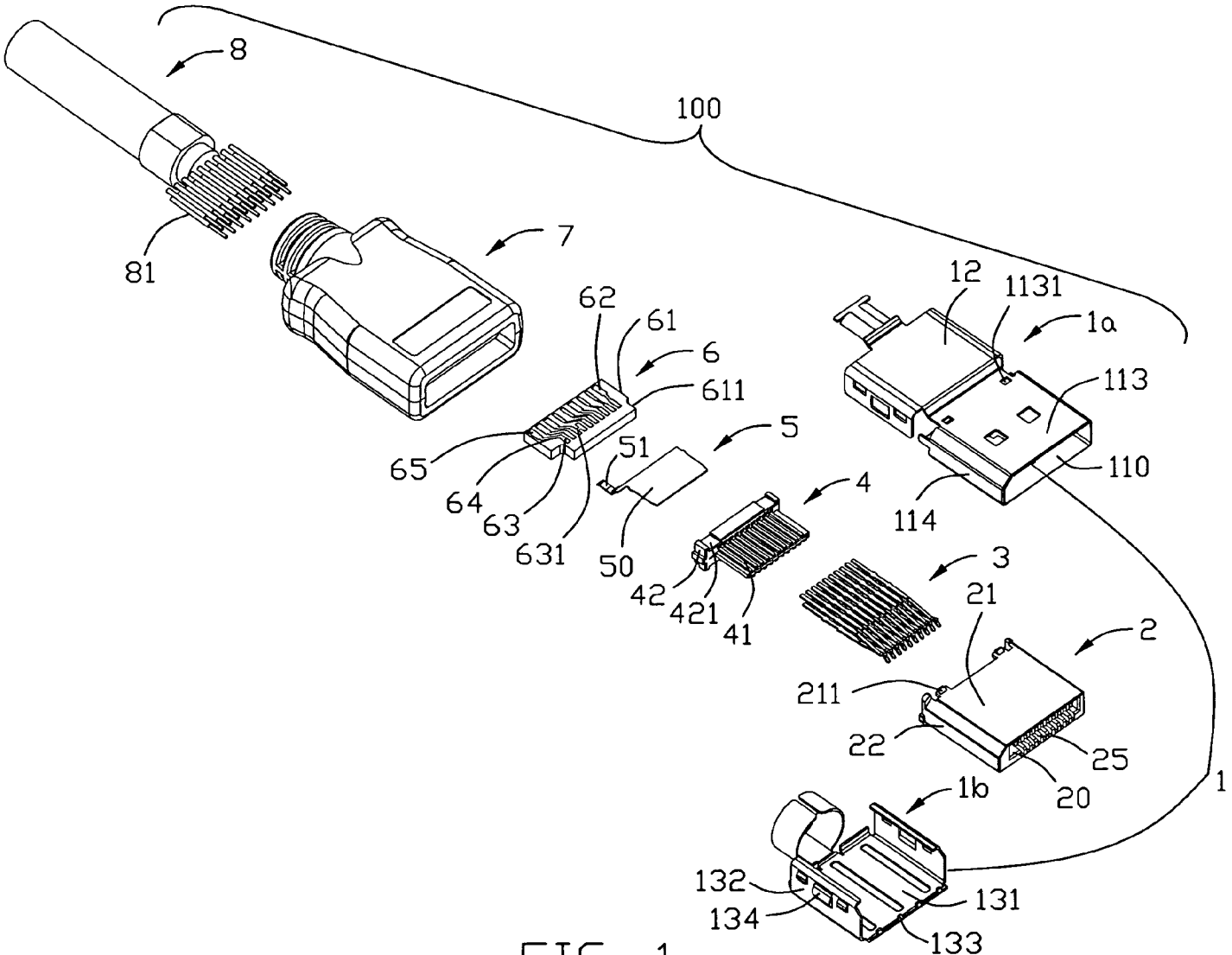
FIG. 1 is an exploded, perspective view of a cable connector in accordance with the present invention.
Figure 2:
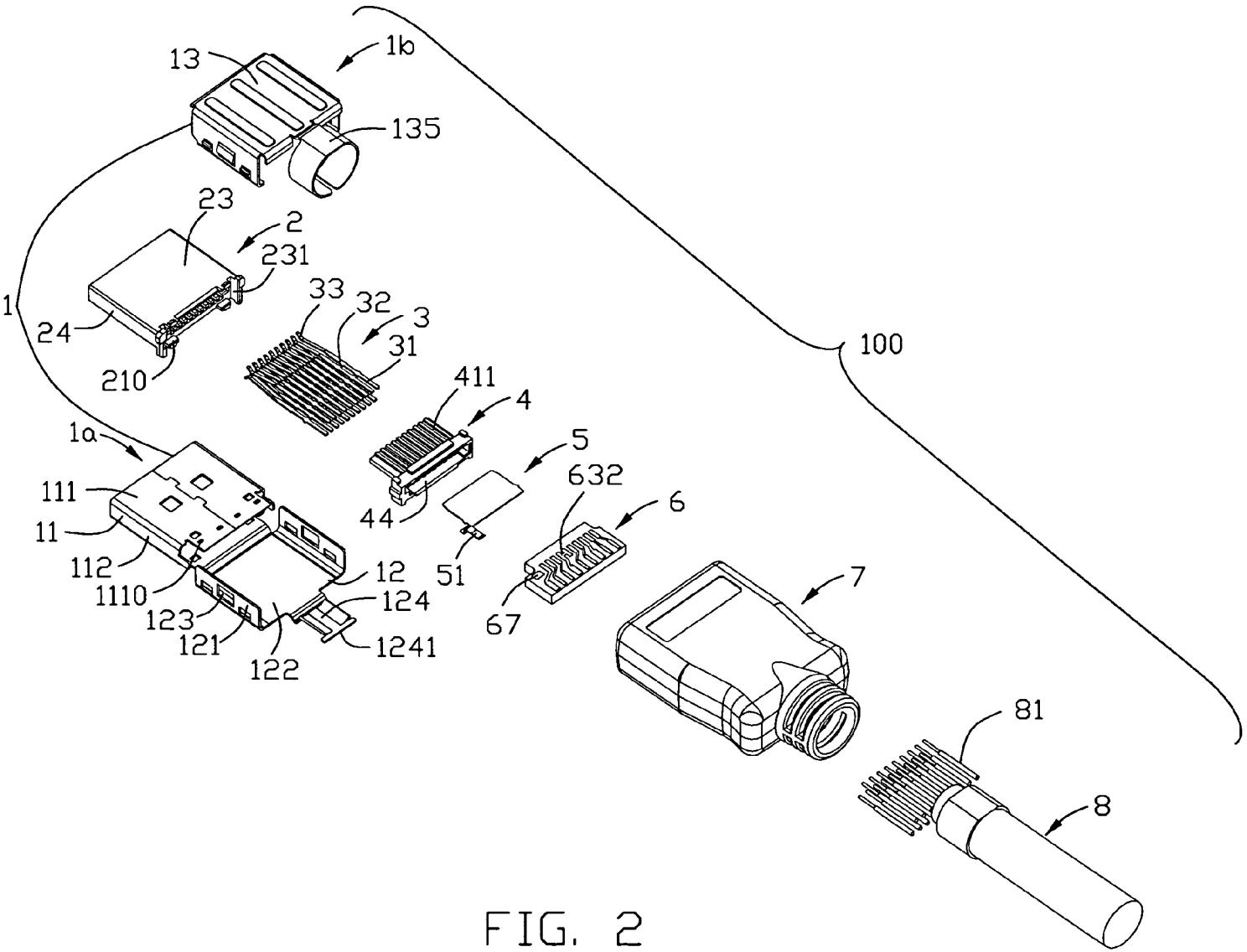
FIG. 2 is similar to FIG. 1, but viewed from another aspect.
Figure 3:
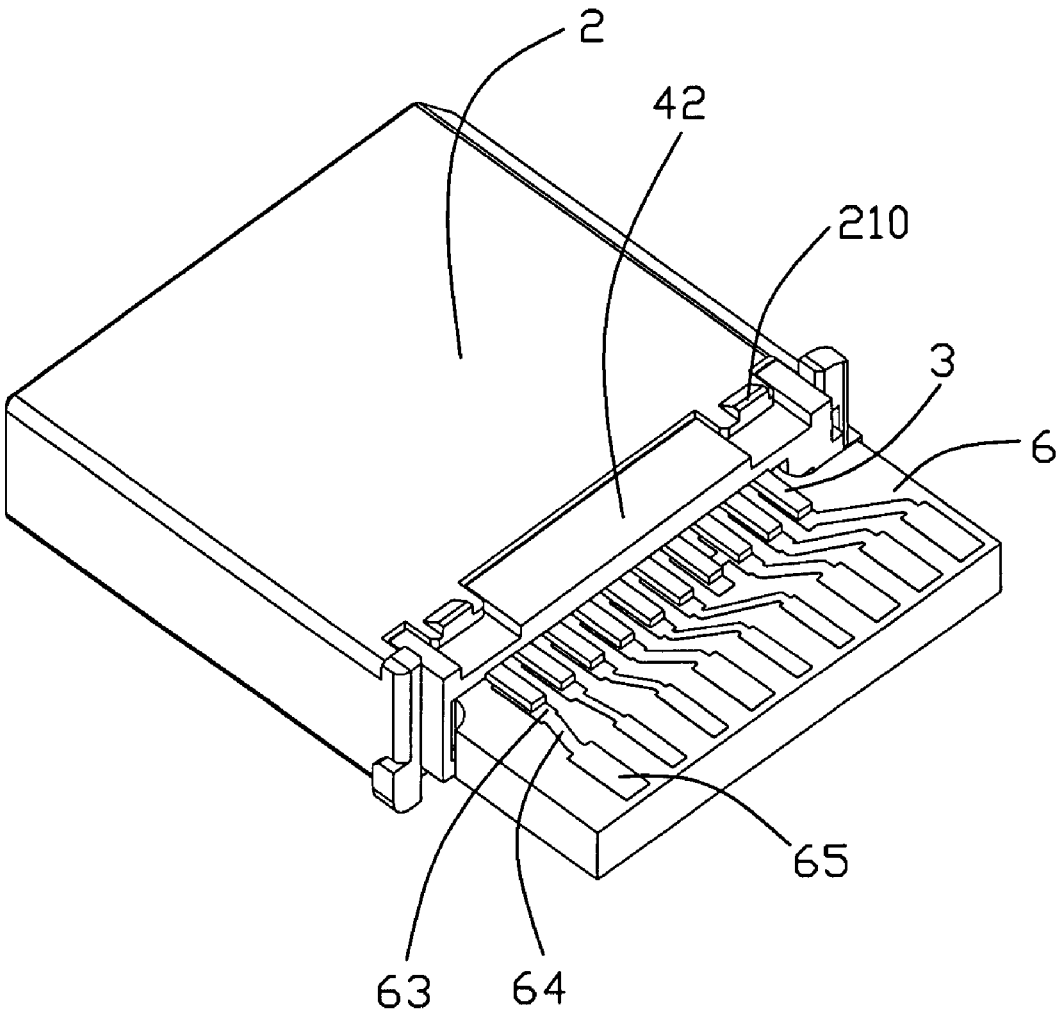
FIG. 3 is a partially assembled, perspective view of the cable connector.
Figure 4:
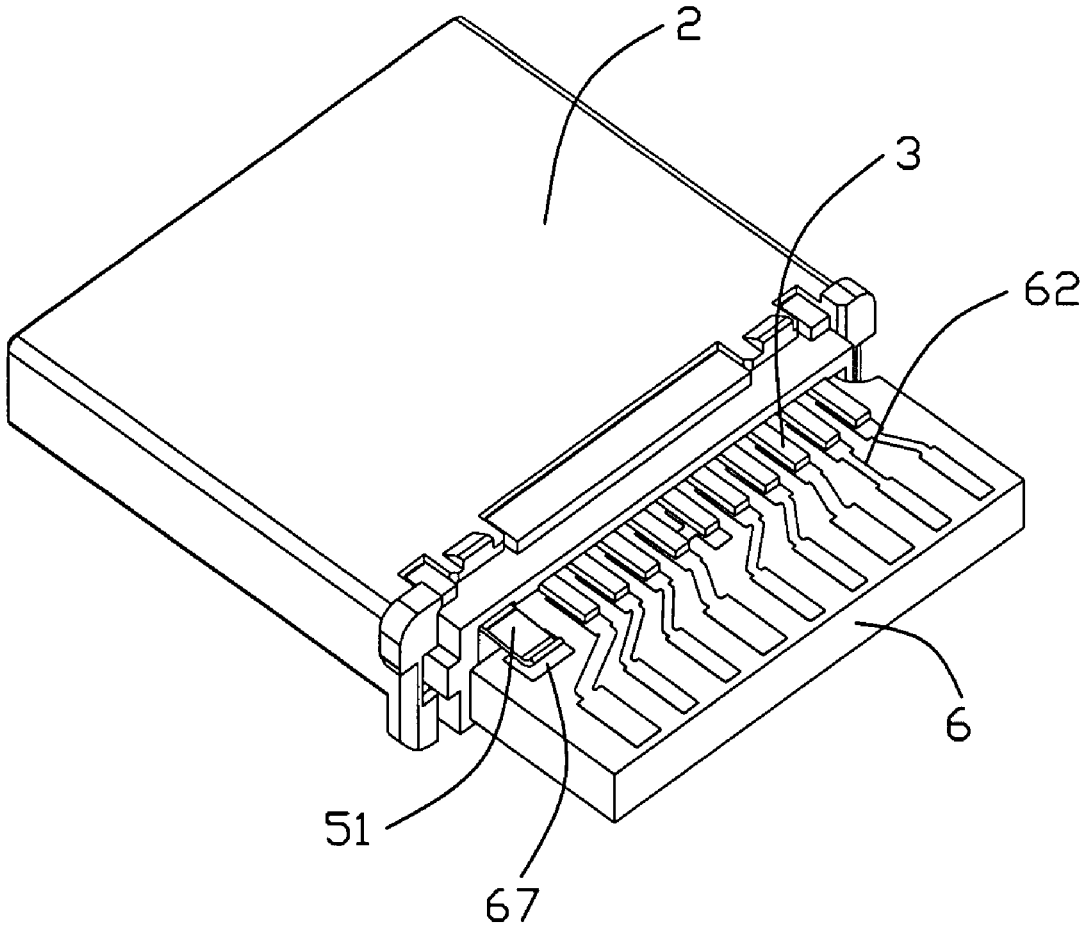
FIG. 4 is similar to FIG. 3, but viewed from another aspect.
Figure 5:
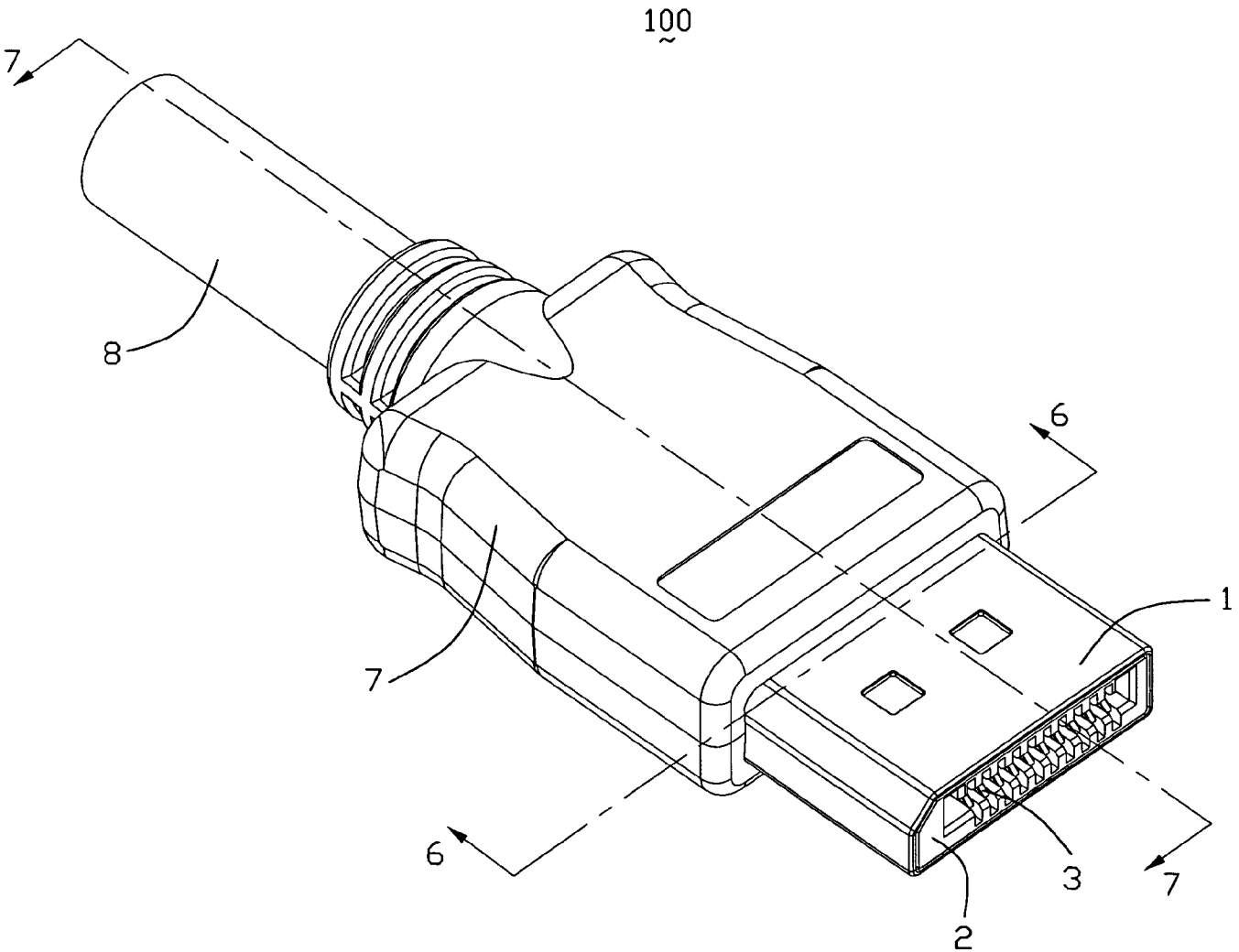
FIG. 5 is an assembled, perspective view of FIG. 1.

Reference will now be made in detail to the preferred embodiment of the present invention.

Referring to FIGS. 1-8, a cable connector 100 in accordance with the present invention comprises an insulated housing 2, a plurality of terminals 3 arranged on a spacer 4 and then together received in the insulated housing 2, a metal plate 5 embedded in the spacer 4, a printed circuit board (PCB) 6 assembled to the spacer 4 and electrically connecting with the terminals 3 and the metal plate 5, a metal shell 1 enclosing the insulated housing 2, a cable 8 with a number of wires 81 respectively electrically connecting to the PCB 6, and a cover 7 partially over molded with the metal shell 1, the insulated housing 2, the spacer 4, the PCB 6 and the cable 8.

The metal shell 1 comprises an upper first shield portion 1*a* and a lower second shield portion 1*b*. The upper first shield portion 1*a* includes an enclosing portion 11 which consists of a bottom side 111, an opposite top side 113, and a pair of transversal sides 112, 114 interconnecting the top and the bottom sides 113, 111 to form a hollow 110 for receiving the insulated housing 2. The upper first shield portion 1*a* further includes an inverted U-shaped first cover portion 12 rearward extending from a rear end of the top side 113 of the enclosing portion 11. The rear section of the bottom side 111 defines four holes 1110 aligned in a row and the rear section of the top side 113 defines a pair of apertures 1131 either. The rear section of the bottom side 111 further has a pair of apertures (not labeled) opposite to the apertures 1131. The inverted U-shaped first cover portion 12 also comprises a flat board portion 122 and a pair of upright sides 121 joining to edges of the flat board portion 122. The inverted U-shaped first cover portion 12 further has a sheet stretching portion 124 being slightly bent to arched configure and extending rearward from middle end edge of the flat board portion 122, and the stretching portion 124 further forms a flat stopper 1241 at the end edge thereof. Each upright side 121 defines three locking holes 123 with different sizes and arranged along mating direction. The lower second shield portion 1*b* includes a U-shaped second cover portion 13 and a cylindrical-shaped cable holder 135 connecting to the second cover portion 13 of the second shield portion 1*b*. The U-shaped second cover portion 13 also comprises a board portion 131 and a pair of upright sides 132 joining to two edges of the board portion 131. Each upright side 132 forms three locking tabs 134 with different sizes corresponding to the locking holes 123 of the upright side 121 of the U-shaped first cover portion 12, and the forward edge of the board portion 131 further forms four tabs 133 thereon.

The insulated housing 2 comprises a top wall 21, an opposite bottom wall 23, and a pair of side walls 22, 24 connecting with the top and the bottom walls 21, 23 to form a receiving space 20. Both the top wall 21 and the bottom wall 23 defines a plurality of terminal passages 25 arranged in two distinct rows and offset from each other respectively. The rear portion of the top wall 21 forms two spaced apart protruding portions 210 each with a locking member 211 thereon. The rear portion of the bottom wall 23 also forms a pair of protruding portions (not labeled) opposite to the protruding portions 210 and each protruding portion (not labeled) has a locking member. Each side wall 22, 24 extend beyond rear surface of the insulated housing 2 to form an expanded tab 231 at the end portion thereon.

Figure 6:
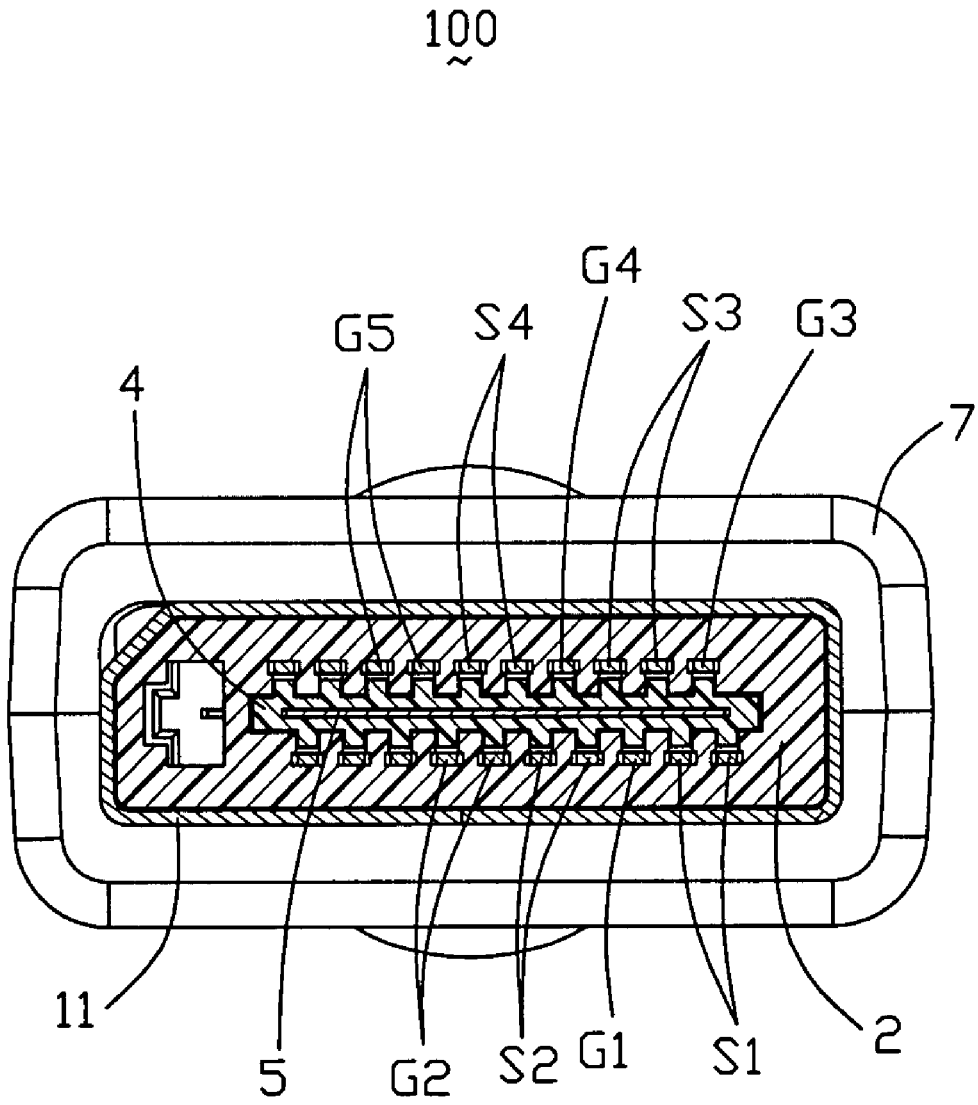
FIG. 6 is a cross-section view of FIG. 5 taken along line 6-6.
Figure 7:
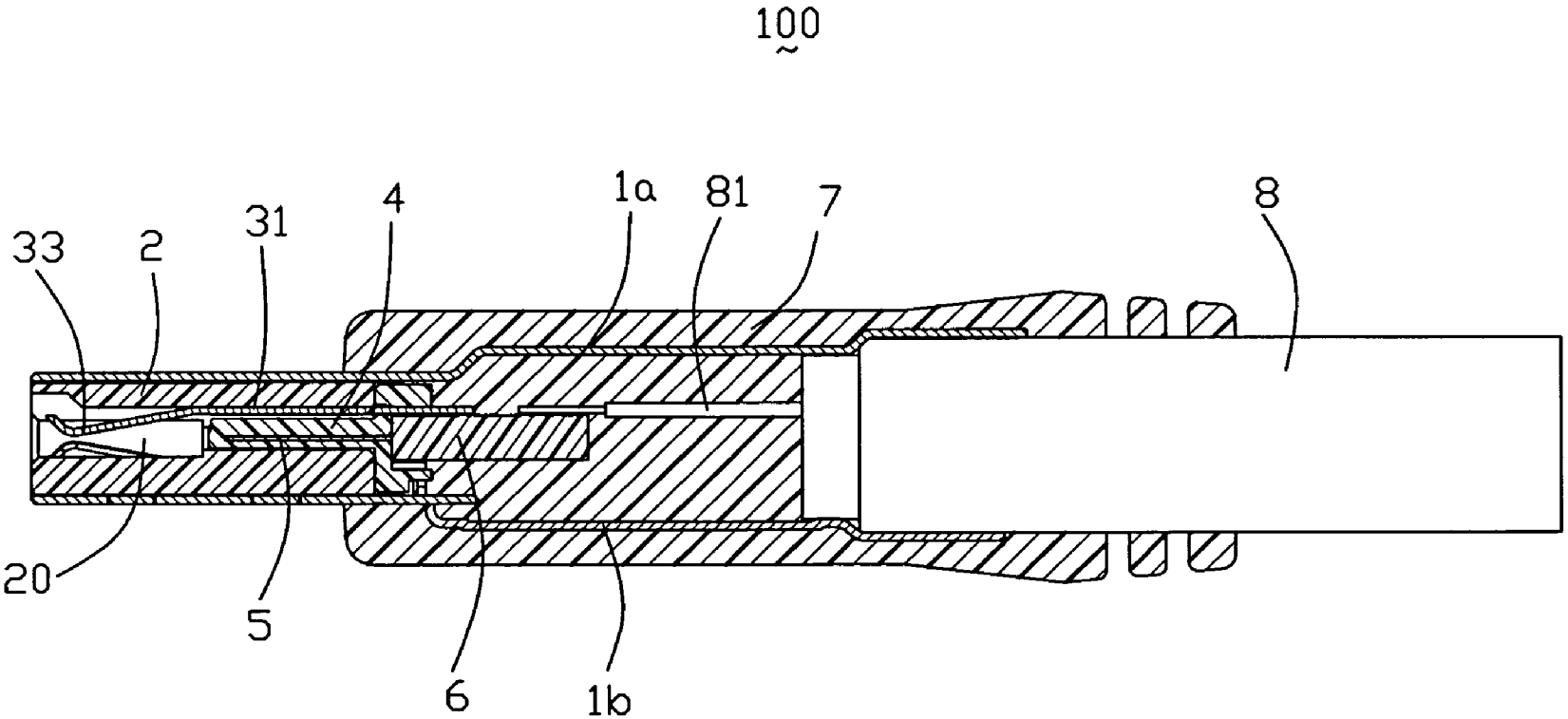
FIG. 7 is a cross-section view of FIG. 5 taken along line 7-7.

Each terminal 3 with identical configuration comprises a flat body portion 32, a curved mating portion 33 extending forward from a front end of the body portion 32, and a flat termination portion 31 extending rearward from a rear end of the body portion 32. The aforementioned terminals 3 are separated into two rows, the upper terminal row and the opposite lower terminal row. Referring to FIG. 6, both the upper terminal row and the lower terminal row have two pairs of differential signal terminal pairs S3, S4 and S1, S2, and the differential signal terminal pairs S1, S2 are offset from the differential signal terminal pairs S3, S4 along vertical (up-to-down) direction. The lower terminal row further includes two groups of first grounding terminals G1, G2 to space the differential signal terminal pairs S1, S2 along horizontal direction. The upper terminal row also has three groups of grounding terminals G3, G4, G5 being spaced by the pair of differential signal terminal pairs S3, S4. Each of the differential signal terminal pairs S1-S4 together with one of directly facing grounding terminals G1-G5 consist of a triangular configuration terminal group viewed from mating direction, such as S1 and G3, S3 and G1, etc.

The spacer 4 comprises a base portion 42 and a tongue portion 41 extending forwardly from a front edge of the base portion 42. An upper surface and a lower surface of the tongue portion 41 have a plurality of terminal slots 411 arranged in a row by side-to-side manner, and the base portion 42 also defines a plurality of through holes (not numbered) each aligns with corresponding terminal slot 411. Both an upper surface and bottom surface of the base portion 42 respectively define two cutouts 421 adjacent to opposite lateral sides thereof. The base portion 42 further has a hollow portion 44 with a rear opening (not numbered).

Figure 8:
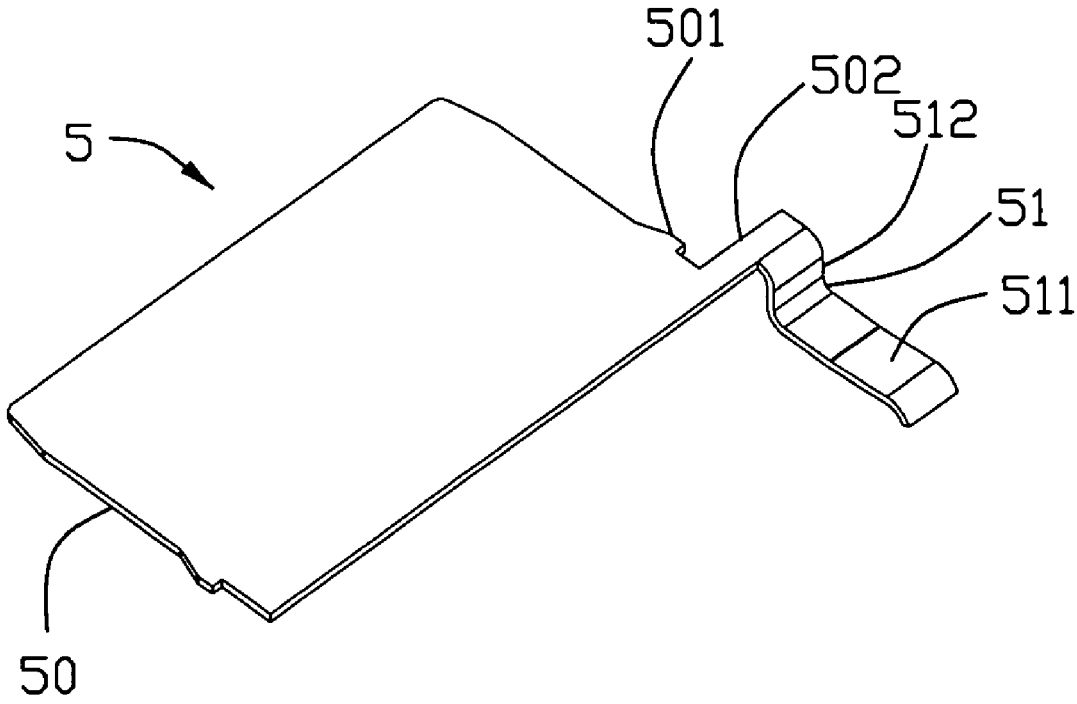
FIG. 8 is an enlarged view of a metal plate.

Referring to FIG. 8, the metal plate 5 is made of a sheet metal and comprises a panel portion 50 and an L-shaped tail portion 51 extending rearwardly from a rear edge of the panel portion 50. The panel portion 50 has a pair of barbs 501 formed at two opposite side edges of a rear section thereof and a stub 502 formed at a corner area thereof and adjacent to one of the barbs 501. The L-shaped tail portion 51 includes a horizontal body part 511 substantially parallel to the panel portion 50 and formed with a curved end and a vertical transition part 512 connecting the body part 511 and the stub 502. The cable 8 includes a number of wires 81 separated into an upper row and a lower row.

The printed circuit board (PCB) 6 includes a board portion 61 and a number of conductive traces 62 arranged on an upper surface and a lower surface of the board portion 61. The board portion 61 further has a narrowed flange portion 611 extending forwardly therefrom. Each conductive trace 62 includes a first conductive pad 63 for soldering corresponding terminal 3 thereon, a second conductive pad 65 for soldering corresponding wire 81 thereon, and a conductive path section 64 connecting with the first conductive pad 63 and the second conductive pad 65; except that the third conductive trace (not numbered) of the upper surface and the fourth conductive trace (not numbered) of the lower surface of the PCB 6 have two first conductive pads (not numbered) coupled together by a conductive bridge section (not numbered) to form an H-shaped conductive pad 631/632. Therefore, either the upper surface or the bottom surface of the PCB 6 has ten first conductive pads 63 and nine second conductive pads 65, and a distance between each two adjacent second conductive pads 65 increases, and it facilitates to solder the wires 81 to the second conductive pads 65 and avoid circuit-short problem when soldering process. The PCB 6 further has a grounding pad 67 arranged on a lower surface of the board portion 61 and located at a left side thereof.

When assembly, firstly, the metal plate 5 is assembled to the spacer 4, with the panel portion 50 of the metal plate 5 inserted into an inner slot (not numbered) of the tongue portion 41 and the body part 511 of the tail portion 51 disposed outside of a rear surface of the base portion 42 of the spacer 4. Secondly, the terminals 3 are arranged on the spacer 4, with the mating portions 33 located beyond a front end of the tongue portion 41, the body portions 32 located in the terminal slots 411 of the tongue portion 41, the termination portions 31 through the through holes of the base portion 42 and disposed outside of the rear surface of the base portion 42 of the spacer 4. Thirdly, the terminals 3 and the spacer 4 are together assembled to the insulated housing 2 till a front edge of the base portion 42 abuts against a rear edge of the insulated housing 2, with the mating portions 33 of the terminals 3 received in the terminal passages 25 of the insulated housing 2, the tongue portion 41 of the spacer 4 received in the receiving space 20, and the protruding portions 210 of the insulated housing 2 received in the cutouts 421 of the base portions 42 of the spacer 4. Fourthly, the PCB 6 is assembled to the spacer 4, with the flange portion 611 of the PCB 6 is inserted into the hollow portion 44 of the base portion 42 of the spacer 4 and the board portion 61 of the PCB 6 is exposed outside of the base portion 42 of the spacer 4, the terminal portions 31 of the grounding terminals G1-G5 and signal terminals S1-S4 disposed on the first conductive pads 63 of the PCB 6, the body part 511 of the tail portion 51 of the metal plate 5 disposed on the grounding pad 67, and the transition part 512 of the tail portion 51 sandwiched between front edge of the flange portion 61 of the PCB 6 and an interior surface of the hollow portion 44 of the base portion 42 of the spacer 4, then the terminal portions 31 are soldered to the first conductive pads 63 of the PCB 6 and the body part 51 of the metal plate 5 is soldered to the grounding pad 67 of the PCB 6. The grounding pad 67 further connects with at least one of the first conductive pads 63 that electrically connecting to the grounding terminals G1-G5 via inner conductive lines (not shown) of the PCB 6.

Fifthly, the wires 81 of the cable 8 are disposed on the second conductive pads 65 and soldered thereto. Sixthly, the insulated housing 2 is wrapped by the enclosing portion 11 of the upper first shield portion 1*a* of the metal shell 1, with the pair of locking members 211 of the two protruding portions 210 of the insulated housing 2 inserted into the pair of apertures 1131 of the rear section of the top side 113 of the enclosing portion 11, simultaneously, the base portion 42 of the spacer 4, the PCB 6 and the exposed wires 81 are disposed in a rectangular space (not numbered) of the U-shaped bottom cover portion 12 of the metal shell 1. Then the lower second shield portion 1*b* is assembled to the upper first shield portion 1*a*, with the tabs 133 of the board portion 131 penetrating into corresponding holes 1110 of the top side 111, the locking tabs 134 of the upright sides 132 of the lower second shield portion 1*b* latching with the locking holes 123 of the upright sides 121 of the upper first shield portion 1*a*, then the cable holder 135 crimped to an end of the cable 8 and the stretching portion 124 of the first shield portion 1*a*, with the flat stopper 1241 of the stretching portion 124 abutting against a rear edge thereof. Seventhly, the cover 7 is molded over part of the metal shell 1 and the cable 7. In the present embodiment, as the metal plate 5 is located between the upper terminal row and the lower terminal row, and the metal plate 5 further electrically connects with the PCB 6, thus, the cross talk among terminals 3 will be greatly reduced or eliminated. Therefore, the signal quality/performance may be improved.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

an insulated housing defining a receiving space;

a plurality of terminals including grounding terminals and signal terminals received in the receiving space of the insulated housing, said terminals being arranged into upper and lower terminal rows;

a metal plate disposed between the upper terminal row and the lower terminal row, said metal plate further having a tail portion connecting thereto;

a cable including a number of wires electrically connecting with the terminals;

a printed circuit board having a plurality of conductive traces and a grounding pad arranged thereon; and wherein the grounding terminals couple to a pre-selected conductive traces of the printed circuit board;

wherein the tail portion of the metal plate electrically connects to the grounding pad;

wherein the grounding pad further electrically connects with the pre-selected conductive traces of the printed circuit board.

2. The cable connector as claimed in claim 1, wherein the upper terminal row includes at least a pair of signal terminals to form a differential pair and the lower terminal row has at least one grounding terminal, and wherein the pair of signal terminals and the grounding terminal are arranged into triangular configuration.

3. The cable connector as claimed in claim 1, wherein the metal plate comprises a panel portion and a tail portion configured to an L-shaped connecting to the panel portion, and wherein the panel portion is located between the upper terminal row and the lower terminal row, and the tail portion is coupled to the printed circuit board.

4. The cable connector as claimed in claim 3, wherein the panel portion of the metal plate has a stub formed at a corner area thereof, and wherein the L-shaped tail portion includes a horizontal body part substantially parallel to the panel portion and a vertical transition part connecting the body part of the tail portion and the stub of the panel portion.

5. The cable connector as claimed in claim 1, wherein the conductive traces of the printed circuit board are arranged on an upper surface and a lower surface thereof, and wherein each of the conductive trace has a conductive path section, at least a first conductive pad coupled to one end of the conductive path section and a second conductive pad coupled to another end of the conductive path section.

6. The cable connector as claimed in claim 5, wherein at least a pair of the first conductive pads are coupled together by a conductive bridge section, and wherein the terminals are soldered to the first conductive pads and the wires of the cable are soldered to the second conductive pads.

7. The cable connector as claimed in claim 1, further comprising a spacer.

8. The cable connector as claimed in claim 7, wherein the spacer has a base portion and a tongue portion extending forwardly from a front edge of the base portion, and wherein the tongue portion is received in the receiving space of the insulated housing, and the base portion is disposed outside a rear surface of the insulated housing.

9. The cable connector as claimed in claim 8, wherein the tongue portion of the spacer has a number of terminal slots, and wherein each of the terminals has a body portion mounted in the terminal slot of the tongue portion, a mating portion extending forward from a front end of the body portion and disposed beyond front end of the tongue portion, and a termination portion extending rearward from a back end of the body portion and disposed beyond a rear edge of the base portion of the spacer.

10. The cable connector as claimed in claim 8, wherein the base portion of the spacer defines a hollow portion with a rear opening, and wherein the printed circuit board defines a flange portion inserted into the hollow portion of the base portion.

11. The cable connector as claimed in claim 10, wherein the metal plate comprises a panel portion inserted into an inner slot of the tongue portion of the spacer and a tail portion connecting to the panel portion and rearwardly extending out of the spacer through the hollow portion of the base portion of the spacer.

12. A cable connector comprising:

an insulated housing including a top wall, an opposite bottom wall, and a pair of side walls connecting with the top and the bottom walls to form a receiving space;

a spacer partially received in the receiving space of the insulated housing;

a plurality of terminals arranged on both sides of the spacer and assembled to the insulated housing;

a cable including a number of wires;

a printed circuit board having a plurality of conductive traces and a grounding pad thereon, each of the individual conductive trace including at least a first conductive pad and a second conductive pad;

wherein the terminals are respectively soldered to the first conductive pads;

wherein the wires of the cable are respectively soldered to the second conductive pads;

wherein at least a pair of the first conductive pads coupled together; and a metal plate embedded in the spacer and further electrically connecting to the grounding pad of the printed circuit board.

13. The cable connector as claimed in claim 12, wherein the spacer has a base portion and a tongue portion extending forwardly from a front edge of the base portion, wherein the tongue portion is inserted into the receiving space of the insulated housing and the base portion is arranged outside of the insulated housing.

14. The cable connector as claimed in claim 13, wherein the metal plate comprises a panel portion and an L-shaped tail portion connecting to the panel portion, and wherein the panel portion is insert into an inner section of the tongue portion, and the tail portion is coupled to the printed circuit board.

15. The cable connector as claimed in claim 14, wherein base portion of the spacer defines a hollow portion with a rear opening, wherein the printed circuit board has a flange portion inserted into the hollow portion of the spacer, and wherein the tail portion of the metal plate is partially sandwiched between the flange portion of the circuit board and the base portion the spacer.

16. The cable connector as claimed in claim 12, further comprising a metal shell having a first shield portion and a second shield portion combined together.

17. The cable connector as claimed in claim 16, wherein the first shield portion includes an enclosing portion and an inverted U-shaped first cover portion engaging with the enclosing portion, and wherein the second shield portion includes a U-shaped second cover portion and a cylindrical-shaped cable holder connecting to the U-shaped second cover portion.

18. The cable connector as claimed in claim 16, further comprises a cover partially over molded the insulated housing, the printed circuit board the metal shell and the cable.

* * * * *